US009360277B2

(12) United States Patent
Kalms et al.

(10) Patent No.: US 9,360,277 B2
(45) Date of Patent: Jun. 7, 2016

(54) MULTIPLE MISSILE CARRIAGE AND LAUNCH GUIDANCE MODULE

(71) Applicant: Lockheed Martin Corporation, Bethesda, MD (US)

(72) Inventors: William Kalms, Parkville, MD (US); John-Nathan Russell Snediker, Felton, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 63 days.

(21) Appl. No.: 13/970,865

(22) Filed: Aug. 20, 2013

(65) Prior Publication Data

US 2015/0053073 A1 Feb. 26, 2015

(51) Int. Cl.

| | |
|---|---|
| ***F41F 3/04*** | (2006.01) |
| ***F41F 3/073*** | (2006.01) |
| *F41F 3/077* | (2006.01) |

(52) U.S. Cl.

CPC ..... *F41F 3/0406* (2013.01); *F41F 3/073* (2013.01); *F41F 3/0413* (2013.01); *F41F 3/077* (2013.01)

(58) Field of Classification Search

CPC ..... F41F 3/0406; F41F 3/04

USPC ..... 89/1.8, 1.816, 1.81, 1.817, 1.803, 89/1.802, 1.807, 1.819

See application file for complete search history.

(56) References Cited

U.S. PATENT DOCUMENTS

| | | | | | |
|---|---|---|---|---|---|
| 2,809,559 | A | * | 10/1957 | Lauritsen | 89/1.819 |
| 2,961,927 | A | * | 11/1960 | Dufour | 89/1.816 |
| 3,106,132 | A | | 10/1963 | Biermann et al. | |
| 3,138,989 | A | * | 6/1964 | Lewis et al. | 89/1.8 |
| 3,724,321 | A | * | 4/1973 | Le Cheualier | H01L 29/435 257/E29.141 |
| 3,899,953 | A | * | 8/1975 | Labruyere | F42B 15/00 244/3.23 |
| 4,362,459 | A | * | 12/1982 | Klausbruckner et al. | 414/584 |
| 4,470,336 | A | * | 9/1984 | Swann | F41A 23/42 89/1.815 |
| H213 | H | * | 2/1987 | Panlaqui | 89/1.8 |
| 5,115,711 | A | * | 5/1992 | Bushagour et al. | 89/1.816 |
| 6,079,310 | A | * | 6/2000 | Yagla et al. | 89/1.816 |
| 6,125,734 | A | * | 10/2000 | Yagla | F41F 3/042 89/1.8 |
| 6,230,604 | B1 | * | 5/2001 | Larson et al. | 89/1.817 |
| 8,534,177 | B2 | * | 9/2013 | Kalms et al. | 89/1.816 |

OTHER PUBLICATIONS

MK 41 Vertical Launching System (VLS), http://www.globalsecurity.org/military/systems/ship/systems/mk-41-vls.htm, printed Aug. 6, 2013, 10 pages.

International Search Report for International Application No. PCT/US2014/051439 filed on Aug. 18, 2014, mailed on Mar. 12, 2015. 3 pages.

* cited by examiner

*Primary Examiner* — Reginald Tillman, Jr.

(74) *Attorney, Agent, or Firm* — Reising Ethington P.C.

(57) ABSTRACT

A multiple missile carriage and launch guidance module comprising a plurality of missile launch rails that are each configured to carry and guide the launch of a missile and are carried on a common missile carriage wall in respective positions and orientations allowing for missile carriage and launch from the rails.

15 Claims, 6 Drawing Sheets

MULTIPLE MISSILE CARRIAGE AND LAUNCH GUIDANCE MODULE

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND

1. Field

This application relates generally to a multi-missile carriage and launch guidance module for supporting the carriage and guiding the launch of a plurality of missiles.

2. Description of Related Art Including Information Disclosed Under 37 CFR 1.97 and 1.98

Surface-to-surface missile launch systems are known to include canisterized missiles. FIG. 2 shows such a system installed in a surface vessel with deck launch bay doors open to show canister-housed (canisterized) missiles carried by missile carriage and launch modules received in launch bays of the surface vessel. Because each missile canister includes its own systems for supporting, communicating with, and controlling the environment of its housed missile, the canisters comprise a significant portion of the launch system's mass. This becomes a liability in that it reduces the total number of missiles that may be carried by a combat system or that may be loaded into a ground, air, or sea transport for resupply.

SUMMARY

A multiple missile carriage and launch guidance module is provided, which comprises a plurality of missile launch rails, each one of which is configured to carry and guide the launch of a missile. A common missile carriage wall may carry the missile launch rails in respective positions and orientations that allow for missile carriage and launch from the rails.

DRAWING DESCRIPTIONS

These and other features and advantages will become apparent to those skilled in the art in connection with the following detailed description and drawings of one or more embodiments of the invention, in which.

DETAILED DESCRIPTION

Figure 6:
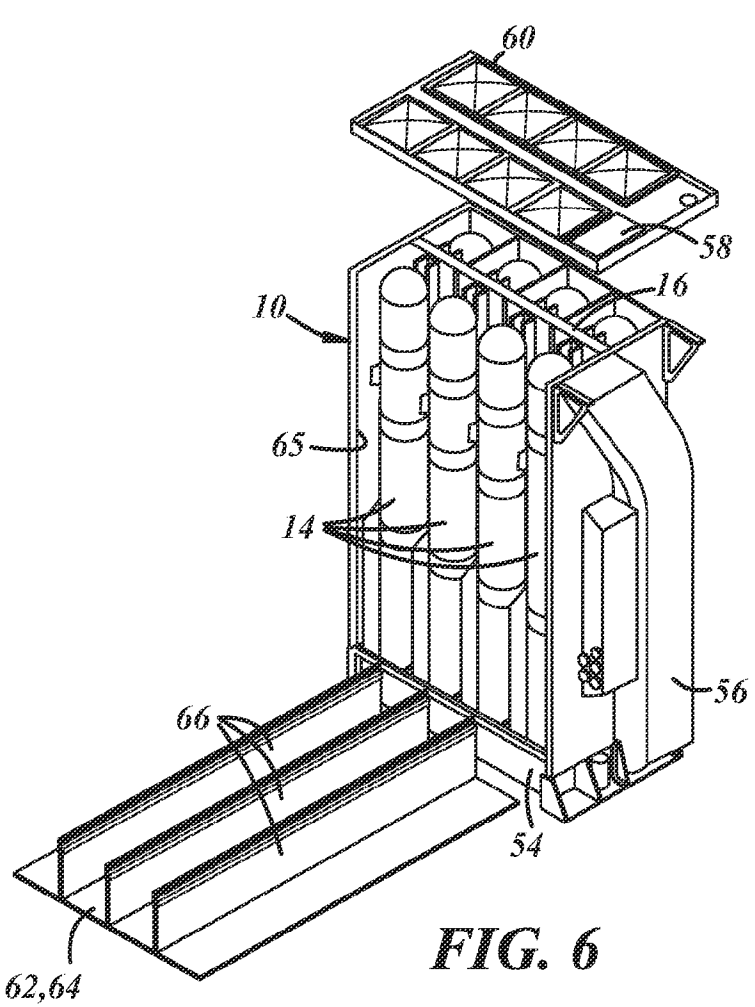
FIG. 6 is a partially-exploded orthogonal view of the carriage and launch guidance module of FIG. 5 with a shell cover and module lid removed to reveal missiles carried internally by the module.
Figure 5:
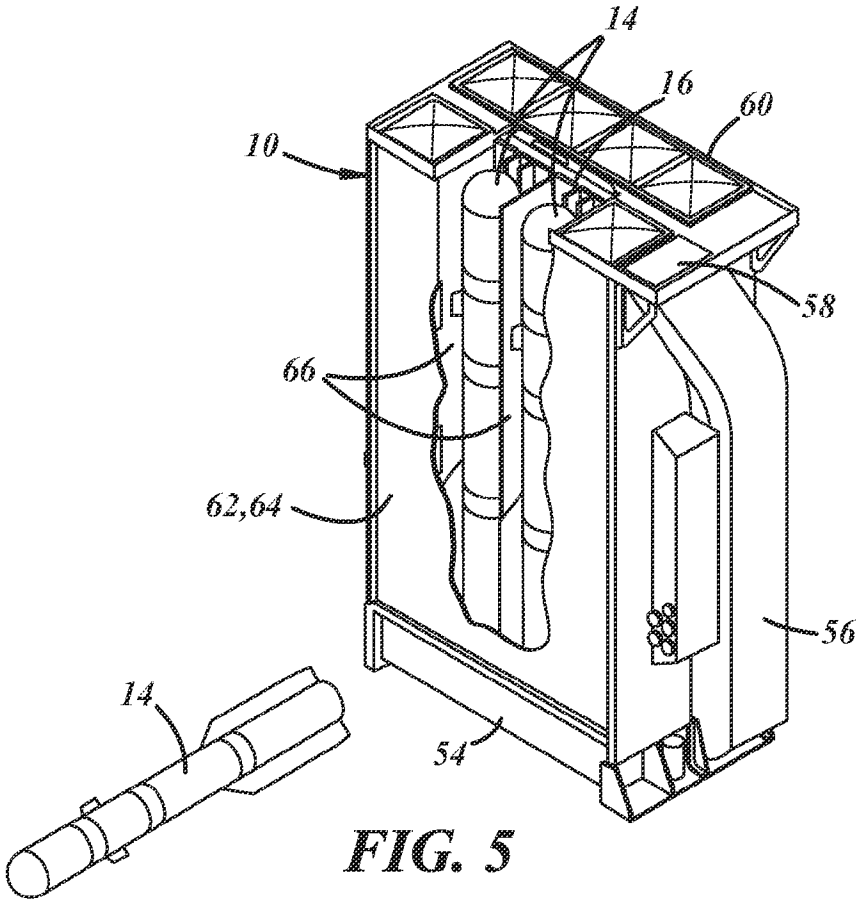
FIG. 5 is an orthogonal partial-cutaway view of one of three carriage and launch guidance modules of the Surface-to-Surface Missile System of FIG. 3.
Figure 7:
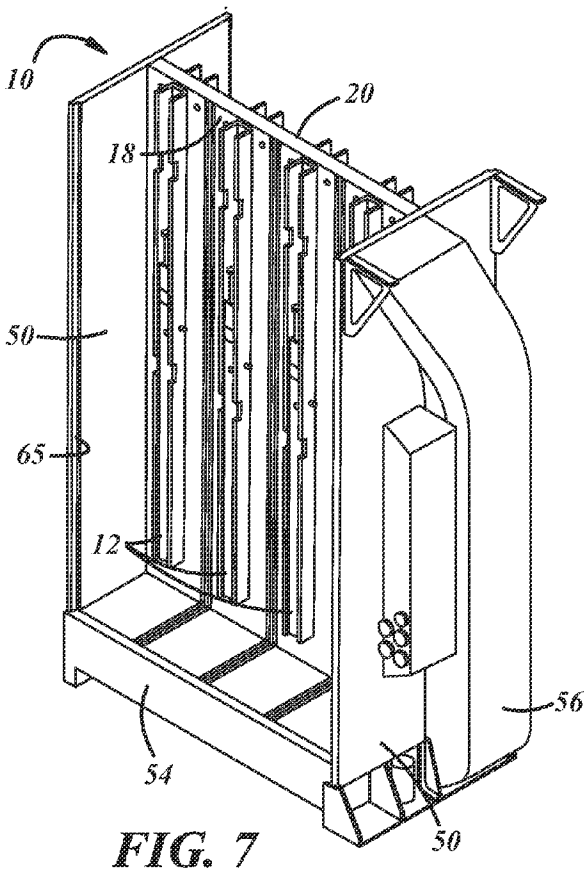
FIG. 7 is an orthogonal view of the carriage and launch guidance module of FIG. 5 with missiles, shell covers, and module lid removed.

A multiple missile carriage and launch guidance module is generally shown at 10 in FIGS. 1, and 3-8. The module 10 may include eight generally parallel missile launch rails 12 as best shown in FIG. 7, although, in other embodiments, any number of rails 12 may be included. The rails 12 may, for example, be of the type used in an M299 Missile Launch System. As shown in FIGS. 5 and 6, each rail 12 may be configured to carry and guide the launch of a missile 14, such as, for example, an AGM-114L Longbow HELLFIRE missile.

Figure 8:
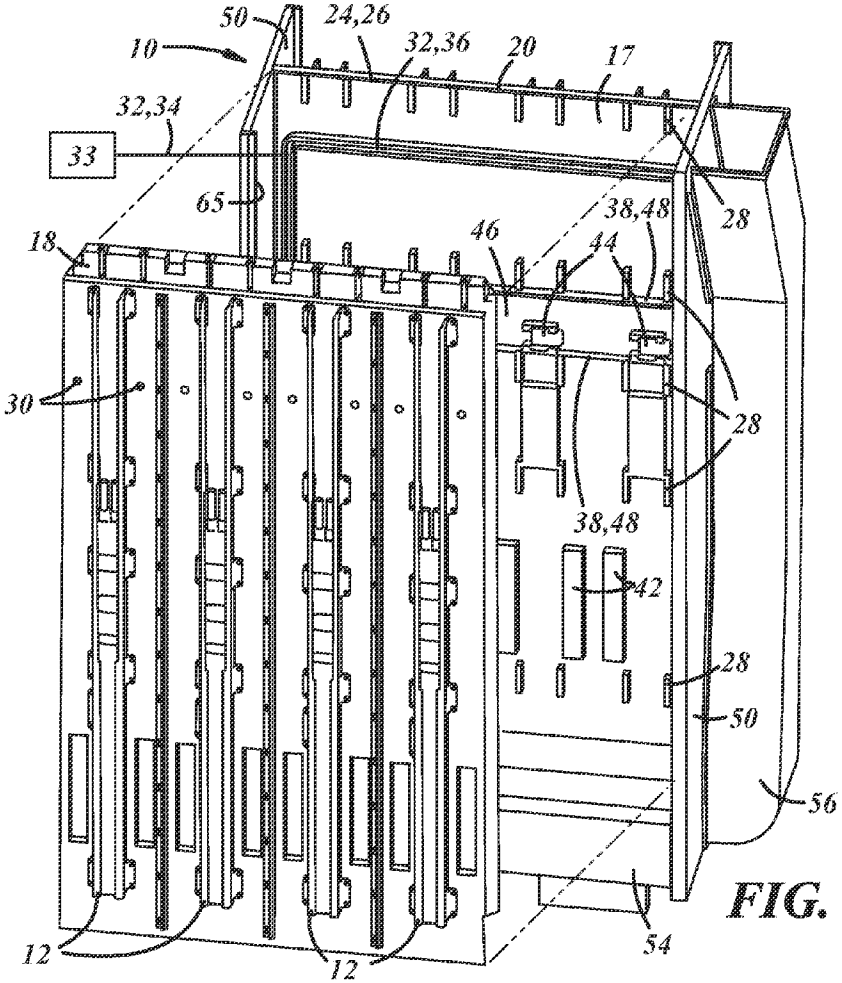
FIG. 8 is a partially-exploded orthogonal view of the carriage and launch guidance module of FIG. 7 with front and back structural skin portions of a missile carriage wall of the module separated to reveal an interior of the carriage wall.

As best shown in FIGS. 7 and 8, the module 10 may also include a common missile carriage wall 16 carrying the missile launch rails 12 in respective positions and orientations allowing for missile carriage and launch from the rails 12. The common missile carriage wall 16 obviates the need to accommodate individually canisterized missiles, reducing module weight and footprint by increasing missile 14 packing density in, for example, an Littoral Combat Ship Vertical Launch System LCSVLS application.

Figure 9:
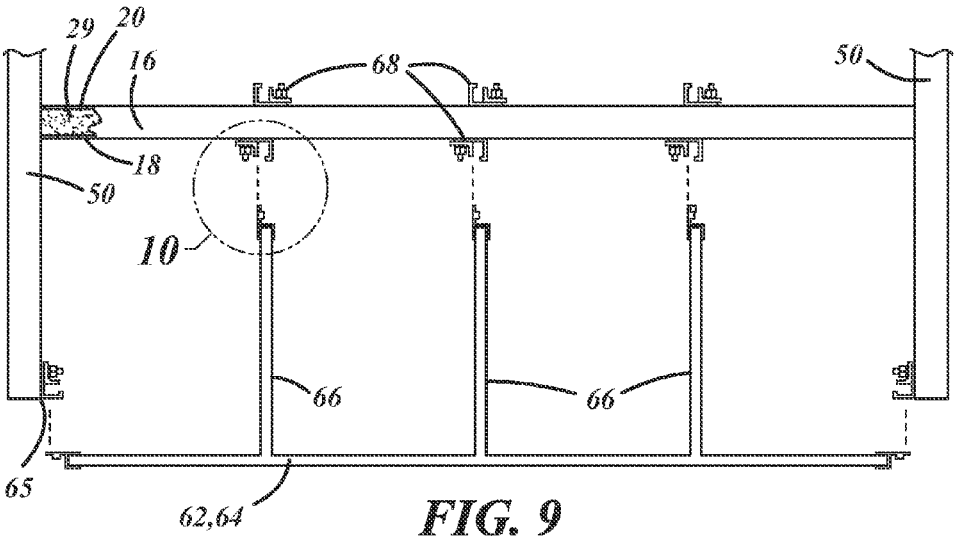
FIG. 9 is a fragmentary partial-cutaway top view of the carriage and launch guidance module with separated shell cover.
Figure 10:
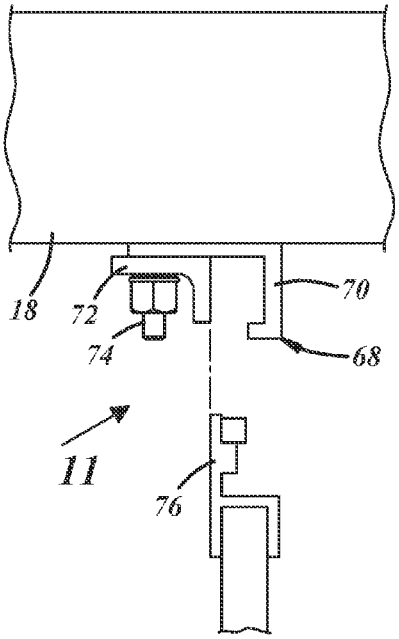
FIG. 10 is a magnified view of circled region 10 of FIG. 9 showing a linear wedge seal interface between the shell cover and the missile carriage wall of the launch guidance module.

As shown in FIGS. 8 and 9, the carriage wall 16 may comprise a carriage wall core 17 defined by generally parallel spaced-apart front and back structural skins 18, 20 of the carriage wall 16. The skins 18, 20 may be joined together around respective peripheral edges by fasteners 22, and may include a rubber O-ring gasket 24 received in a channel 26 formed around the peripheral edge of one or both of the structural skins. The gasket 24 may be sandwiched between the peripheral edges of the skins 18, 20 to close and seal the carriage wall core 17. The carriage wall skins 18, 20 may be configured to cooperate in the carriage and distribution of missile carriage loads. The carriage wall structural skins 18, 20 may be machined from aluminum slabs or may, in other embodiments, be formed by any suitable means from any suitable material.

As shown in FIGS. 7 and 8, the rails 12 may be distributed between and carried by the front and back structural skins 18, 20 of the carriage wall 16. Four of the eight rails 12 may be carried by the front skin 18 of the carriage wall 16 and the remaining four rails 12 carried by the back skin 20 of the carriage wall 16. The launch rails 12 of the plurality of launch rails 12 may be spaced laterally and oriented generally parallel to one another on the front and back skins 18, 20 of the carriage wall 16.

To provide structural stiffness in the carriage wall 16, the front and back structural skins 18, 20 may be machined to leave hard points 28 that project integrally inward from inner surfaces of the skins 18, 20 as shown in FIG. 8. The hard points 28 may be configured to engage one another when the skins 18, 20 are closed together. Alternatively, or in addition to the hard points 28, the carriage wall 16 may comprise a filler 29 disposed between the front and back structural skins 18, 20 to add stiffness. The filler 29 may comprise, for example, aluminum honeycomb or a heat-resistant materials comprising, for example, Nomex®.

As shown in FIG. 8, the module 10 may include sprinkler nozzles 30 carried by and distributed between the front and back structural skins 18, 20 of the carriage wall 16. Sixteen such nozzles 30 are distributed between the front and back structural skins 18, 20 in the present embodiment, but in other embodiments any suitable number of sprinkler nozzles 30 may be used. Each sprinkler nozzle 30 may be connected to sprinkler piping 32 that may be connected to a fluid source 33. The sprinkler piping 32 may be configured to provide a fluid pathway through the carriage wall core 17 and carriage wall structural skins 18, 20 for a fluid, such as a fire suppressant fluid, to be delivered to and dispensed through the sprinkler nozzles 30. The sprinkler nozzles 30 may be configured to dispense fluid in a direction and manner that suppresses missile exhaust flame. The sprinkler nozzles 30 may be selected, configured, and/or positioned to perform in a manner that meets safety requirements for whatever type of missiles 14 are to be carried by and launched from the module 10. For example, the nozzles 30 may be configured to spray fluid in a pattern that will wet-down and cool critical components such as warheads and/or pressure vessel sections of missiles 14 carried by the rails 12. The nozzles 30 may also or alternatively be located relatively high on the carriage wall 16 to allow gravity to help direct the spray pattern to cover a vast majority of desired areas and components.

As shown in FIG. 8 the sprinkler piping 32 may include an external portion 34 extending from the fluid source 33 to the carriage wall 16, and an internal portion 36 extending through the carriage wall core 17. The internal portion 36 may comprise machined-in piping walls that integrally extend from at least one of the inner surfaces of the structural skins 18, 20 and compress rubber seal strips 38 against an opposing inner surface or piping wall to define a fluid channel between the structural skins 18, 20.

The sprinkler piping 32 may further comprise a penetration interface (not shown) disposed between peripheral edges of the carriage wall structural skins 18, 20. The penetration interface may be configured to provide fluid communication between the external and internal sprinkler piping portions 34, 36 while maintaining a seal between the peripheral edges of the carriage wall structural skins 18, 20. The penetration interface may comprise any suitable interface known in the art such as, for example, a fluid tube cable that extends between the carriage wall structural skins 18, 20 and that is sealed by a gland nut. Alternatively, the penetration interface may comprise a bulkhead interface comprising a permanent or quick disconnect connector mounted and sealed to one or both carriage wall structural skins 18, 20.

The module 10 may include desiccant holder structures 42 configured to carry long-term storage desiccant within the carriage wall core 17 to maintain a dry environment within the carriage wall core 17. As shown in FIG. 8, the desiccant holder structures 42 may be machined into the inner surfaces of the carriage wall skins 18, 20 to support the desiccant material in advantageous locations within the core 17.

The module 10 may include environmental sensors 44 disposed in the carriage wall core 17 as shown in FIG. 8. The environmental sensors 44 may be configured to monitor conditions within the core 17 such as temperature, humidity, shock, vibration and the like, to monitor maintenance and safety requirements.

FIG. 8 shows that the carriage wall 16 may include an integral cableway 46 comprising cableway walls 48 that integrally extend from the inner surfaces of at least one of the structural skins 18, 20 and compress rubber seal strips 38 against an opposing inner surface or cableway wall to define a cable channel between the structural skins 18, 20. The cableway walls 48 may run through the carriage wall core 17 and cooperate to form a channel configured to receive cabling (not shown), such as missile umbilical cabling, connecting the missiles 14 mounted on the rails 12 to a launcher electronics assembly such as an M299 Launcher Electronics Assembly (LEA) from an M299 missile launch system. The missile umbilical cabling may carry signals related to munitions control and monitoring. The integral cableway 46 may also or alternatively receive rail cabling connecting the rails 12 to the launcher electronics assembly for controlling and/or powering the environmental sensors 44, and/or other systems such as access/intrusion sensors, and/or rail-related electromechanical devices.

Figure 1:
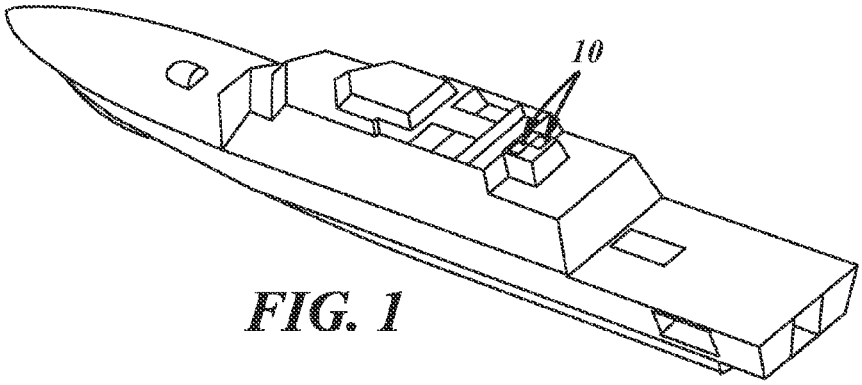
FIG. 1 is a perspective view of a ship carrying a Surface-to-Surface Mission Module including two Surface-to-Surface Missile Systems.
Figure 2:
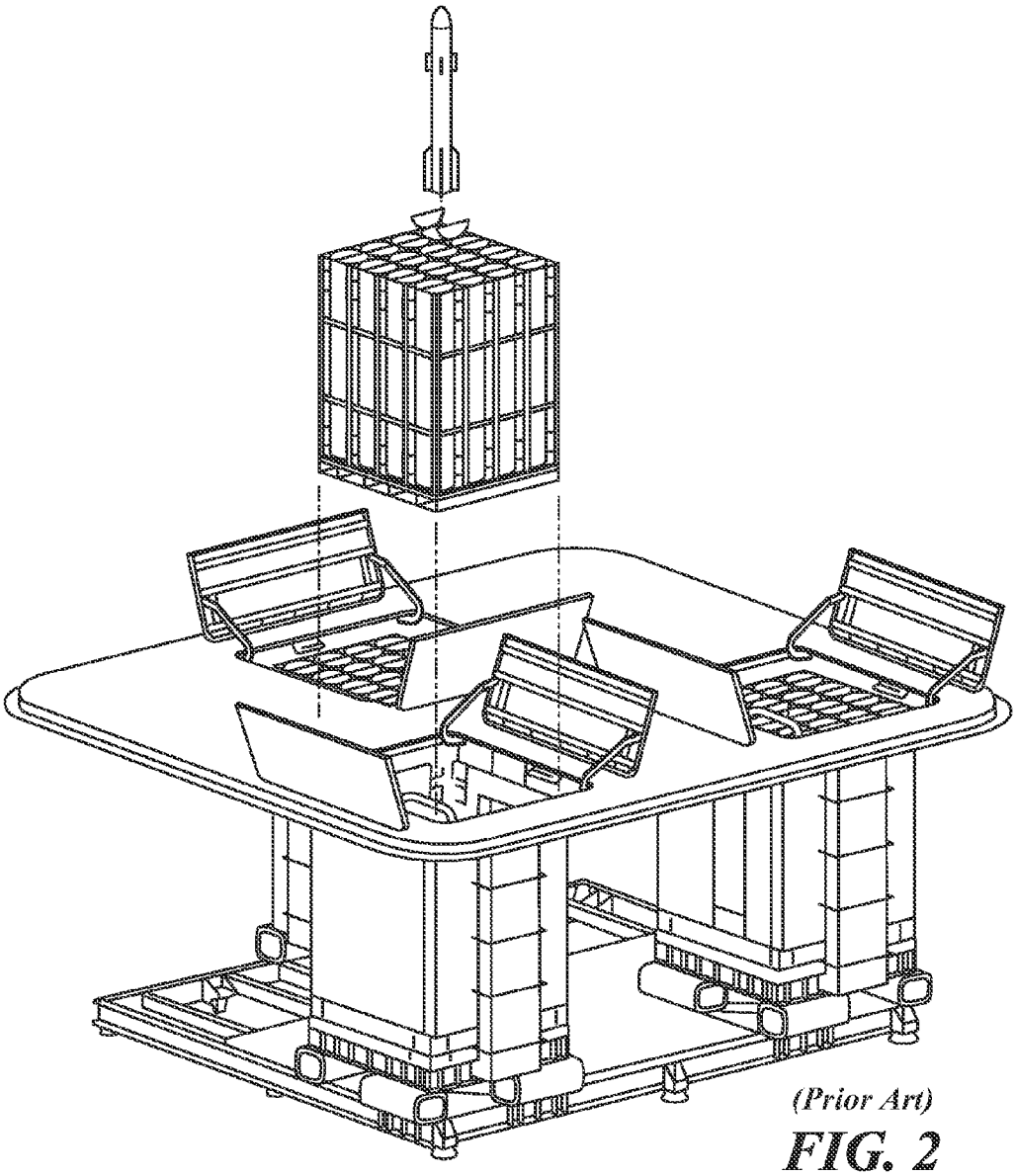
(Prior Art) FIG. 2
FIG. 2 is a perspective view of a prior art Surface-to-Surface Mission Module including three prior art carriage and launch guidance modules.
Figure 3:
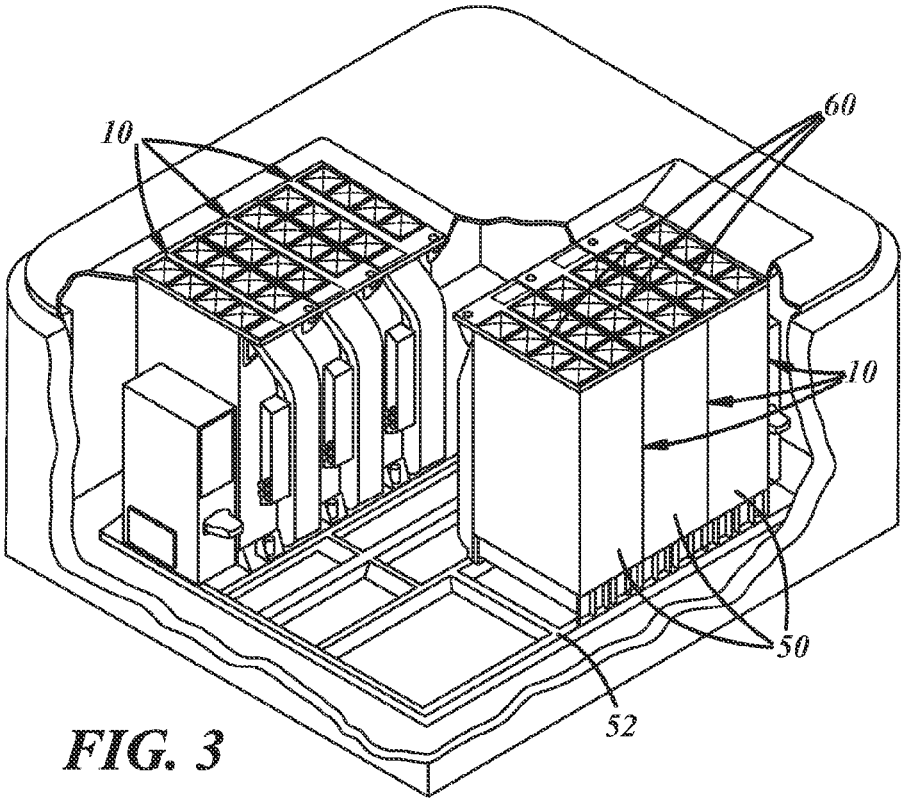
FIG. 3 is an orthogonal view of the Surface-to-Surface Mission Module of FIG. 1 cut away to show two Surface-to-Surface Missile Systems.
Figure 4:
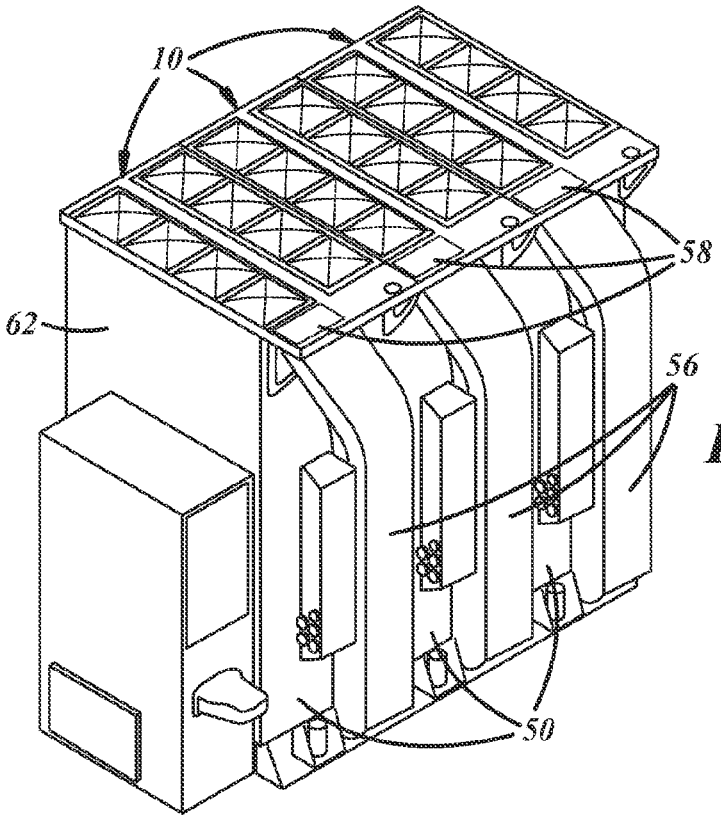
FIG. 4 is an orthogonal view of one of the Surface-to-Surface Missile Systems of FIG. 3.

As shown in FIGS. 3-9, the module 10 may include a pair of spaced-apart generally parallel end walls 50 carrying the common carriage wall 16 between them. As shown in FIG. 3, the end walls 50 may be configured to be carried by mounting interfaces of a module supporting structure 52, e.g., a ship-board structure configured to carry a missile carriage and launch module 10. Such a ship-board structure 52 may include a set of C channels or I beams that may carry attachment point hardware, e.g., a Base Ship Structure (BSS) or slightly modified version thereof.

As shown in FIGS. 5-8, the module 10 may include a plenum 54 carried by and between the end walls 50. The plenum 54 may be configured and positioned to receive and re-direct exhaust gases from missiles 14 being launched from the module 10. The plenum 54 may direct the exhaust gases to a discharge chute 56 configured to direct gases up through an uptake hatch 58 level with a deck of a ship in which the module 10 is mounted as best shown in FIG. 6. The plenum 54 may include siliconized ablatives on interior surface areas of the plenum 54 where missile exhaust impinges, and may include other types of ablatives on other interior surface areas.

As shown in FIGS. 3-6, the module 10 may include a module lid 60 (or deck interface) carried by, and connected to and sealed by any suitable means to a top edge of the carriage wall 16. The module lid 60 may be connected and sealed by any suitable means to top edges of the end walls 50. The module lid 60 may be mounted flush with the deck as shown in FIG. 3, and may include a rigid rectangular opening grid which may support flexible membranes configured to tear open when missiles 14 are launched through them. The carriage wall 16, module lid 60, plenum 54, and end walls 50 may be interconnected in such a way as to provide structural stiffness between these elements and to transfer loads from the carriage wall 16 and plenum to mounting interfaces of a structure, e.g., a ship-board structure, which is to carry the module 10.

As best shown in FIGS. 7 and 8, the end walls 50 may be connected by any suitable means at or adjacent respective top ends to the module lid 60. At or adjacent respective lower ends of the end walls 50, the end walls 50 may be connected to the plenum 54. The end walls 50 may be connected along inner vertical median regions to respective side edges of the carriage wall 16. The end walls 50 may thus support the plenum 54 in a position to receive and re-direct exhaust gases from missiles 14 being launched from the module 10, and to provide structural rigidity between the carriage wall 16, module lid, and the mounting interfaces of a structure carrying the module 10.

The module 10 may include front and back generally rectangular shell covers 62 removably disposed across and closing respective front and back module openings. The front module opening may be defined by front edges of the module lid 60, end walls 50, and plenum 54. The back opening may be defined by back edges of the module lid 60, end walls 50, and plenum 54. The shell covers 62 may be removable to provide access to the rails 12 and/or missiles 14 carried by the rails 12.

As best shown in FIGS. 5 and 6, each shell cover 62 may comprise a main cover panel 64 shaped to be removably disposed across and close a module opening 65, and 3 missile separator panels 66 integrally extending from the main cover panel 64. The missile separator panels 66 may be spaced apart and configured to engage the carriage wall 16 and divide the spaces between the carriage wall 16 and the shell covers 62 into cells for individually housing missiles 14 carried by the rails 12 to protect such missiles 14 from each others' exhaust during launch. While the Figures show three missile separator panels 66 being used to separate four missiles 14 per shell cover 62, other embodiments may employ shell covers 62 configured with either more or fewer separator panels 66 corresponding to the various numbers of rails 12, missiles 14, etc. included in that embodiment.

Figure 11:
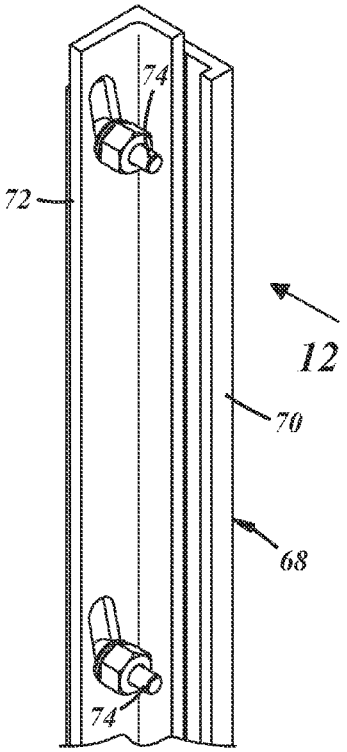
FIG. 11 is an isometric view of the linear wedge seal of FIG. 10.
Figure 12:
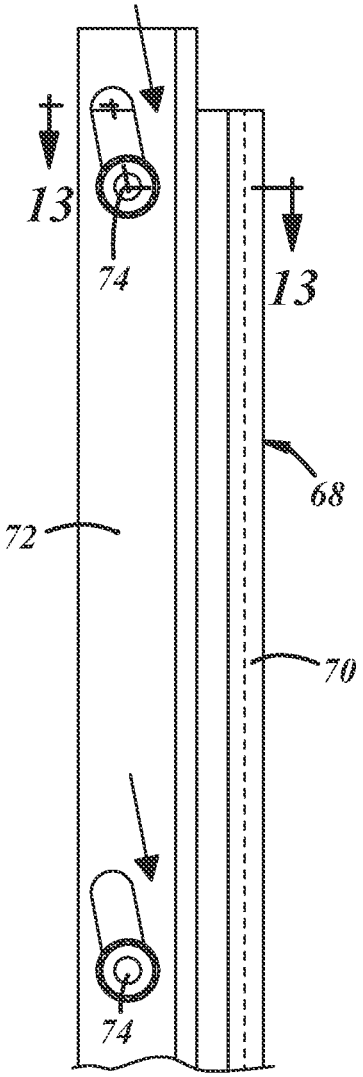
FIG. 12 is a side view of the linear wedge seal of FIG. 10 with the seal shown in a disengaged position.
Figure 13:
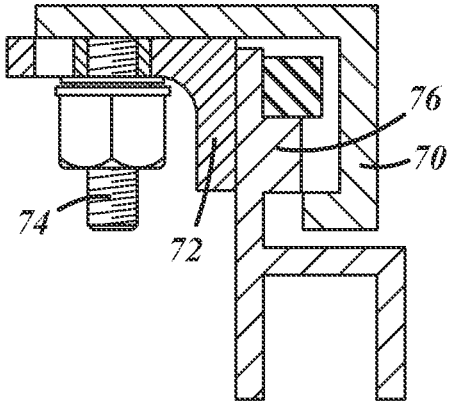
FIG. 13 is a cross-sectional view of the linear wedge seal of FIG. 10 taken along line 13-13 of FIG. 12 and showing a linear hook of the linear wedge seal as it is positioned with the linear wedge seal in its disengaged position.
Figure 14:
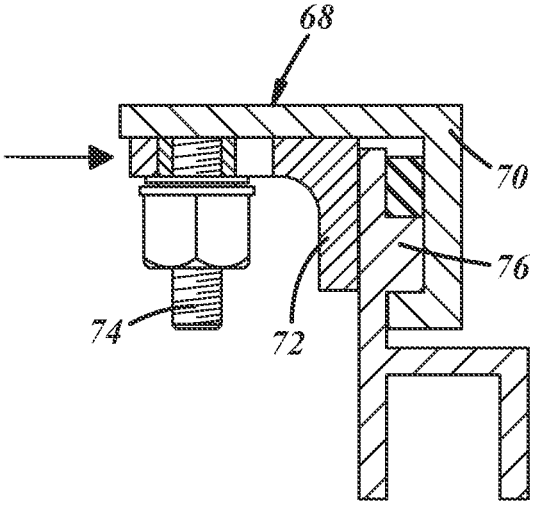
FIG. 14 is a cross-sectional view of the linear wedge seal of FIG. 10 showing the linear hook as it is positioned with the linear wedge seal in its engaged position.

The separator panels 66 may be sealed against outer surfaces of the carriage wall structural skins by, for example, linear wedge seals 68 configured to receive and engage mating linear hooks 76, as shown in FIGS. 9-14. The linear wedge seals 68 may comprise a sliding clamp 72, a brace 70, and mounting bolts 74 configured to attach the sliding clamp 72 to the brace 70. The sliding clamp 72 may include diagonal slots configured to receive the mounting bolts 74, such that the sliding clamp 72 may slide around the mounting bolts 74 along a path that allows it to approach and withdraw from the brace 70 as shown in FIGS. 11 and 12. The linear wedge seal 68 may be configured to receive the mating linear hook 76 between the brace 70 and the sliding clamp 72, and may be configured to seal the linear hook 76 between the brace 70 and the sliding clamp 72 by sliding the sliding clamp 70 along the path allowed by the diagonal slots 76 until it establishes a compression seal with the brace 70 and the linear hook 76 as shown in FIG. 14. As shown in FIG. 9, one of the linear hook 76 or linear wedge seal 68 may be carried by the carriage wall 16, the end walls 50, and/or by any of the main cover or separator panels 64, 66, such that each linear hook 76 may engage a linear wedge seal 68 when the cover panel 64 is installed. In the drawings the wedge seals 68 and linear hooks 76 are configured such that each cover panel 64 may be installed by sliding the cover panel's linear hooks 76 endwise into wedge seals 68 installed on the carriage wall 16 and end walls 60. In other words, the cover panels 64 may be installed vertically through the top of the module 10. However, in other embodiments, the wedge seals 68 may be oriented to allow the shell covers 62 to be installed from the sides of the module 10, into each module opening 65, or from any other unobstructed direction.

A typical configuration of an LCSVLS may, for example, include a Surface-to-Surface Mission Module (SSMM) comprising two Surface-to-Surface Missile Systems (SSMS). Each SSMS may include three missile launch modules 10, and a Launcher Management Assembly (LMA), e.g., an M299 LMA. Each LMA may be configured to control the three launch modules 10 in its SSMS. Each module 10 may be individually removable from its SSMS, allowing a module 10 with expended missiles 14 to be removed and reloaded with missiles 14 or replaced with a pre-loaded module 10.

A multiple missile carriage and launch guidance module as described above provides a space and weight-efficient platform capable of safely storing, monitoring, and launching missiles. This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A multiple missile carriage and launch guidance module comprising:

a plurality of missile launch rails;

a common missile carriage wall comprising generally parallel spaced-apart front and back structural skins, the carriage wall structural skins each carrying at least one missile launch rail of the plurality of missile launch rails such that the plurality of missile launch rails are carried in respective positions and orientations allowing for missile carriage and launch from the rails; and at least one integral channel defined at least in part by:

a first channel wall that integrally extends from an inner surface of one of the carriage wall structural skins and engages either an opposing inner surface of the other structural skin of the front and back carriage wall structural skins or an opposing channel wall extending inward from the opposing inner surface; and a second channel wall spaced laterally from the first channel wall and integrally extending from the inner surface of one of the front and back carriage wall structural skins and engaging either an opposing inner surface of the other structural skin of the front and back carriage wall structural skins or an opposing channel wall extending inward from the opposing inner surface, with the front and back carriage was structural skins closed together.

2. A multiple missile carriage and launch guidance module as defined in claim 1 in which the rails are distributed between and carried by opposite-facing front and back sides of the carriage wall.

3. A multiple missile carriage and launch guidance module as defined in claim 2 in which the carriage wall comprises a carriage wall core defined by the front and back structural skins, the front and back structural skins being interconnected such that they cooperate in the carriage and distribution of missile carriage loads.

4. A multiple missile carriage and launch guidance module as defined in claim 3 in which the carriage wall comprises filler disposed between the front and back structural skins.

5. A multiple missile carriage and launch guidance module as defined in claim 1 in which the module includes:

at least one sprinkler nozzle carried by the carriage wall to emit fluid to suppress missile exhaust flame; and sprinkler piping connected at an outlet end to the sprinkler nozzle and connectable at an inlet end to a fluid source, providing a fluid pathway from a fluid source through the carriage wall core and carriage wall structural skin to the sprinkler nozzles.

6. A multiple missile carriage and launch guidance module as defined in claim 5 in which the sprinkler piping includes the at least one fluid channel and includes piping walls comprising the channel walls of the at least one fluid channel.

7. A multiple missile carriage and launch guidance module as defined in claim 3 and further comprising desiccant carried by the carriage wall within the carriage wall core.

8. A multiple missile carriage and launch guidance module as defined in claim 3 and further comprising at least one environmental sensor carried by the carriage wall and disposed within the carriage wall core to monitor one or more conditions within the core selected from the group of conditions consisting of temperature, humidity, shock or vibration.

9. A multiple missile carriage and launch guidance module as defined in claim 3 in which the carriage wall includes an integral cableway running through the carriage wall core to receive cabling, the integral cableway comprising the at least one integral channel.

10. A multiple missile carriage and launch guidance module as defined in claim 1 and further comprising a pair of spaced-apart end walls carrying the common wall between them and shaped to be carried by mounting interfaces of a module supporting structure.

11. A multiple missile carriage and launch guidance module as defined in claim 10 and further comprising a plenum carried by the end walls and positioned to receive and redirect exhaust gases from missiles being launched from the module.

12. A multiple missile carriage and launch guidance module as defined in claim 11 in which:

the module includes a module lid carried by the carriage wall and the end walls; and the carriage wall, plenum, and end walls are interconnected in such a way as to provide structural stiffness between these elements and to transfer loads from the carriage wall and plenum to mounting interfaces of a structure that is to carry the module.

13. A multiple missile carriage and launch guidance module as defined in claim 12 in which the end walls are connected to the module lid, to the plenum, and side edges of the carriage wall.

14. A multiple missile carriage and launch guidance module as defined in claim 10 and further comprising front and back shell covers removably disposed across and closing respective front and back module openings, the front opening being defined by front edges of the module lid, end walls, and plenum; and the back opening being defined by back edges of the module lid, end walls, and plenum.

15. A multiple missile carriage and launch guidance module as defined in claim 14 in which the shell covers each comprise:

a main cover panel shaped to be removably disposed across and to close a module opening; and a plurality of missile separator panels integrally extending from the main cover panel and spaced apart and configured to engage the carriage wall and divide the spaces between the carriage wall and the shell covers into cells for housing missiles carried by the rails.

* * * * *